US011727834B2

(12) United States Patent
Kim

(10) Patent No.: US 11,727,834 B2
(45) Date of Patent: Aug. 15, 2023

(54) ROTARY LED DISPLAY DEVICE

(71) Applicant: KONO CORPORATION LTD, Seoul (KR)

(72) Inventor: Keon Ho Kim, Seoul (KR)

(73) Assignee: KONO CORPORATION LTD, Seoul (KR)

( * ) Notice: Subject to any disclaimer, the term of this patent is extended or adjusted under 35 U.S.C. 154(b) by 98 days.

(21) Appl. No.: 17/501,307

(22) Filed: Oct. 14, 2021

(65) Prior Publication Data

US 2022/0398954 A1 Dec. 15, 2022

(30) Foreign Application Priority Data

Jun. 15, 2021 (KR) ..... 10-2021-0077586

(51) Int. Cl.

| | |
|---|---|
| ***G09G 3/00*** | (2006.01) |
| ***G09F 13/22*** | (2006.01) |
| ***G09F 9/33*** | (2006.01) |
| ***G09F 9/37*** | (2006.01) |

(52) U.S. Cl.

CPC ..... *G09G 3/005* (2013.01); *G09F 9/33* (2013.01); *G09F 9/37* (2013.01); *G09F 13/22* (2013.01); *G09F 2013/222* (2013.01)

(58) Field of Classification Search

CPC ..... G09F 2013/222; G09F 13/22; G09F 9/33; G09F 9/37; F21V 23/0492; G09G 3/005

See application file for complete search history.

(56) References Cited

U.S. PATENT DOCUMENTS

| | | | | | |
|---|---|---|---|---|---|
| 547,066 | A * | 10/1895 | Farnum | G02B 27/06 | 40/526 |
| 5,041,947 | A * | 8/1991 | Yuen | G09G 3/005 | 40/433 |
| 5,057,827 | A * | 10/1991 | Nobile | G09F 9/33 | 349/1 |
| 5,717,416 | A * | 2/1998 | Chakrabarti | G09G 3/005 | 345/44 |
| 6,936,980 | B2 * | 8/2005 | Wang | B60Q 1/326 | 301/37.108 |
| 7,161,256 | B2 * | 1/2007 | Fang | H02K 7/1807 | 290/1 R |
| 7,179,149 | B2 * | 2/2007 | Chernick | A63H 33/22 | 446/485 |
| 7,236,146 | B2 * | 6/2007 | Smedley | G09G 3/001 | 40/410 |

(Continued)

FOREIGN PATENT DOCUMENTS

| | | |
|---|---|---|
| CN | 207517297 U | 6/2018 |
| JP | H08-179712 A | 7/1996 |

(Continued)

*Primary Examiner* — David R Dunn
*Assistant Examiner* — Christopher E Veraa
(74) *Attorney, Agent, or Firm* — Harness, Dickey & Pierce, P.L.C.

(57) ABSTRACT

According to the present embodiments, it is possible to provide a rotary LED display device which reduces the size of the device and can be installed in various location so as to reduce the restrictions on installation space and location. The embodiments may provide a rotary LED display device capable of allowing a user to freely change the display contents immediately and satisfying the durability suitable for long-term operation.

20 Claims, 12 Drawing Sheets

(56) References Cited

U.S. PATENT DOCUMENTS

| | | | | |
|---|---|---|---|---|
| 7,361,074 | B1 * | 4/2008 | Periman | A63H 37/00 362/199 |
| 9,895,620 | B1 * | 2/2018 | Walterscheid | A63H 1/24 |
| 9,984,605 | B2 * | 5/2018 | Berjeron | G09G 3/005 |
| 10,869,429 | B2 * | 12/2020 | Wilmering | A01G 9/249 |
| 2002/0135541 | A1 * | 9/2002 | Kowalewski | G09G 3/005 345/204 |
| 2010/0033945 | A1 * | 2/2010 | Huang | G09F 9/33 362/35 |
| 2012/0314405 | A1 * | 12/2012 | Culpepper | G09F 13/30 362/427 |
| 2018/0190169 | A1 * | 7/2018 | Berjeron | G09F 19/02 |
| 2019/0035317 | A1 * | 1/2019 | Rohena | G06F 3/167 |
| 2019/0086665 | A1 * | 3/2019 | Pletenetskyy | G02B 27/0176 |
| 2019/0228690 | A1 * | 7/2019 | Meng | G09G 3/14 |
| 2021/0035160 | A1 * | 2/2021 | Xu | H02K 7/063 |
| 2021/0097906 | A1 * | 4/2021 | Chykeyuk | G09F 19/12 |
| 2021/0192996 | A1 * | 6/2021 | Onuki | G09F 9/37 |

FOREIGN PATENT DOCUMENTS

| | | | |
|---|---|---|---|
| JP | 2008-040325 | A | 2/2008 |
| KR | 10-0436645 | B1 | 6/2004 |
| KR | 10-2231054 | B1 | 3/2021 |

* cited by examiner

ROTARY LED DISPLAY DEVICE

CROSS REFERENCE TO RELATED APPLICATION

This application claims priority from Korean Patent Application No. 10-2021-0077586, filed on Jun. 15, 2021, which is hereby incorporated by reference for all purposes as if fully set forth herein.

TECHNICAL FIELD

The present embodiments relate to a rotary LED display device, and more particularly, to a display device capable of displaying advertisements using an afterimage effect generated by rotating an LED.

BACKGROUND

A display device using a rotary LED is a display device which displays desired information using an afterimage effect generated by rotating a plurality of LED light sources on a predetermined trajectory accordingly. As an example, it is a device capable of displaying texts, images, or videos for advertisements, guidance, warnings, and the like.

The conventional display devices such as billboards using LEDs take a lot of time to manufacture, and in order to change the display contents after being manufactured, there is a problem such as having to re-program the display by requesting the manufacturer again. In addition, the conventional display device using the LED mainly has a signboard shape, so there is a problem in that the installation location or place is limited.

Meanwhile, although a miniaturized display device using a rotary LED has been proposed, it is intended for use in emergency situations and has a problem in that it does not satisfy the durability required for long-term use, such as when displaying advertisements.

SUMMARY

The present embodiments are proposed in the background described above, and relate to a rotary LED display device which reduces the size of the device and can be installed in various location so as to reduce the restrictions on installation space and location. The present embodiments relate to a rotary LED display device capable of allowing an user to freely change the display contents immediately and satisfying the durability suitable for long-term operation.

In one aspect, embodiments of the present disclosure may provide a rotary LED display device including: a first rotation module including a first center portion and a first rod portion extending in a radial direction from the first center portion; a second rotation module including a second center portion and a second rod portion extending in a radial direction from the second center portion and having an LED light emitting unit provided on a front surface thereof, in which the first center portion being coupled to a front surface of the second center portion to be relatively rotatable within a predetermined range, and when a relative rotation angle is greater than or equal to the predetermined range, the second rotation module rotating together with the first rotation module; and a driving module including a motor having a motor shaft coupled to the first center portion to rotate the first rotating module and a power control unit for supplying and controlling power to the motor and the LED light emitting unit.

According to the present embodiments, it is possible to provide a rotary LED display device which reduces the size of the device and can be installed in various location so as to reduce the restrictions on installation space and location. The embodiments may provide a rotary LED display device capable of allowing a user to freely change the display contents immediately and satisfying the durability suitable for long-term operation.

DETAILED DESCRIPTION

Figure 1:
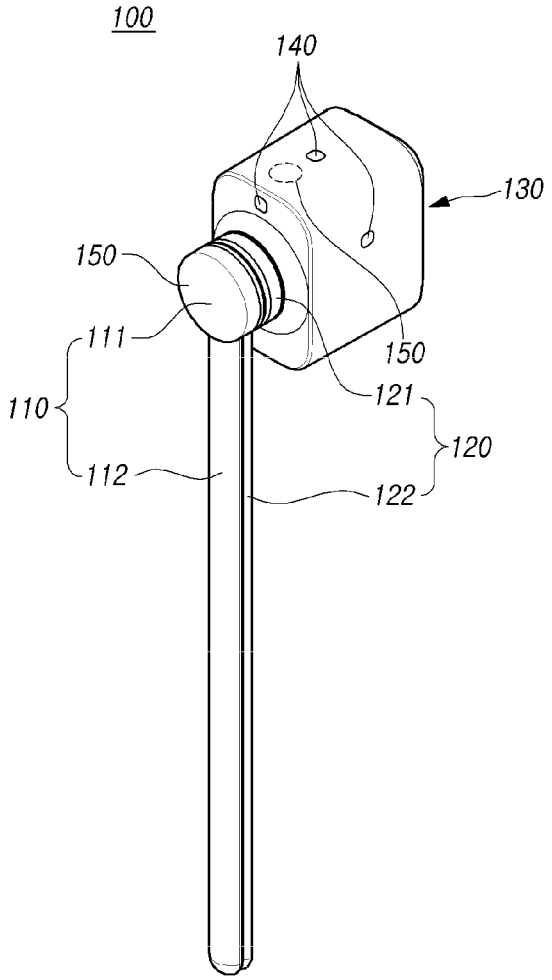
FIG. 1 is a perspective view of a rotary LED display device according to the present embodiments.

In the following description of examples or embodiments of the present disclosure, reference will be made to the accompanying drawings in which it is shown by way of illustration specific examples or embodiments that can be implemented, and in which the same reference numerals and signs can be used to designate the same or like components even when they are shown in different accompanying drawings from one another. Further, in the following description of examples or embodiments of the present disclosure, detailed descriptions of well-known functions and components incorporated herein will be omitted when it is determined that the description may make the subject matter in some embodiments of the present disclosure rather unclear. The terms such as "including", "having", "containing", "constituting" "make up of", and "formed of" used herein are generally intended to allow other components to be added unless the terms are used with the term "only". As used herein, singular forms are intended to include plural forms unless the context clearly indicates otherwise.

Terms, such as "first", "second", "A", "B", "(A)", or "(B)" may be used herein to describe elements of the present disclosure. Each of these terms is not used to define essence, order, sequence, or number of elements etc., but is used merely to distinguish the corresponding element from other elements.

When it is mentioned that first element "is connected or coupled to", "contacts or overlaps" etc. a second element, it should be interpreted that, not only can the first element "be directly connected or coupled to" or "directly contact or overlap" the second element, but a third element can also be "interposed" between the first and second elements, or the first and second elements can "be connected or coupled to", "contact or overlap", etc. each other via a fourth element. Here, the second element may be included in at least one of two or more elements that "are connected or coupled to", "contact or overlap", etc. each other.

When time relative terms, such as "after," "subsequent to," "next," "before," and the like, are used to describe processes or operations of elements or configurations, or flows or steps in operating, processing, manufacturing methods, these terms may be used to describe non-consecutive or non-sequential processes or operations unless the term "directly" or "immediately" is used together.

In addition, when any dimensions, relative sizes etc. are mentioned, it should be considered that numerical values for an elements or features, or corresponding information (e.g., level, range, etc.) include a tolerance or error range that may be caused by various factors (e.g., process factors, internal or external impact, noise, etc.) even when a relevant description is not specified.

Figure 2:
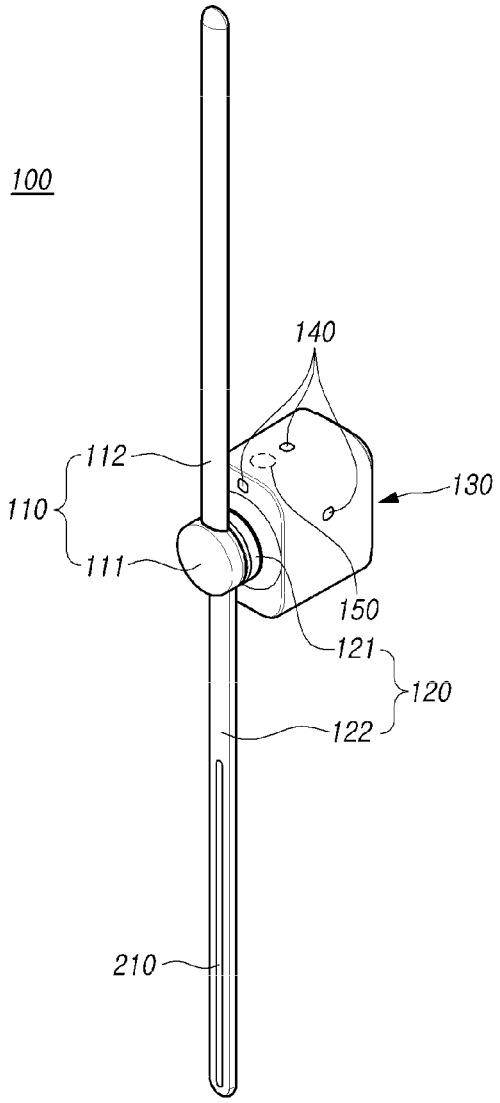
FIG. 2 is a perspective view of a deployed state of a rotary LED display device according to the present embodiments.
Figure 3:
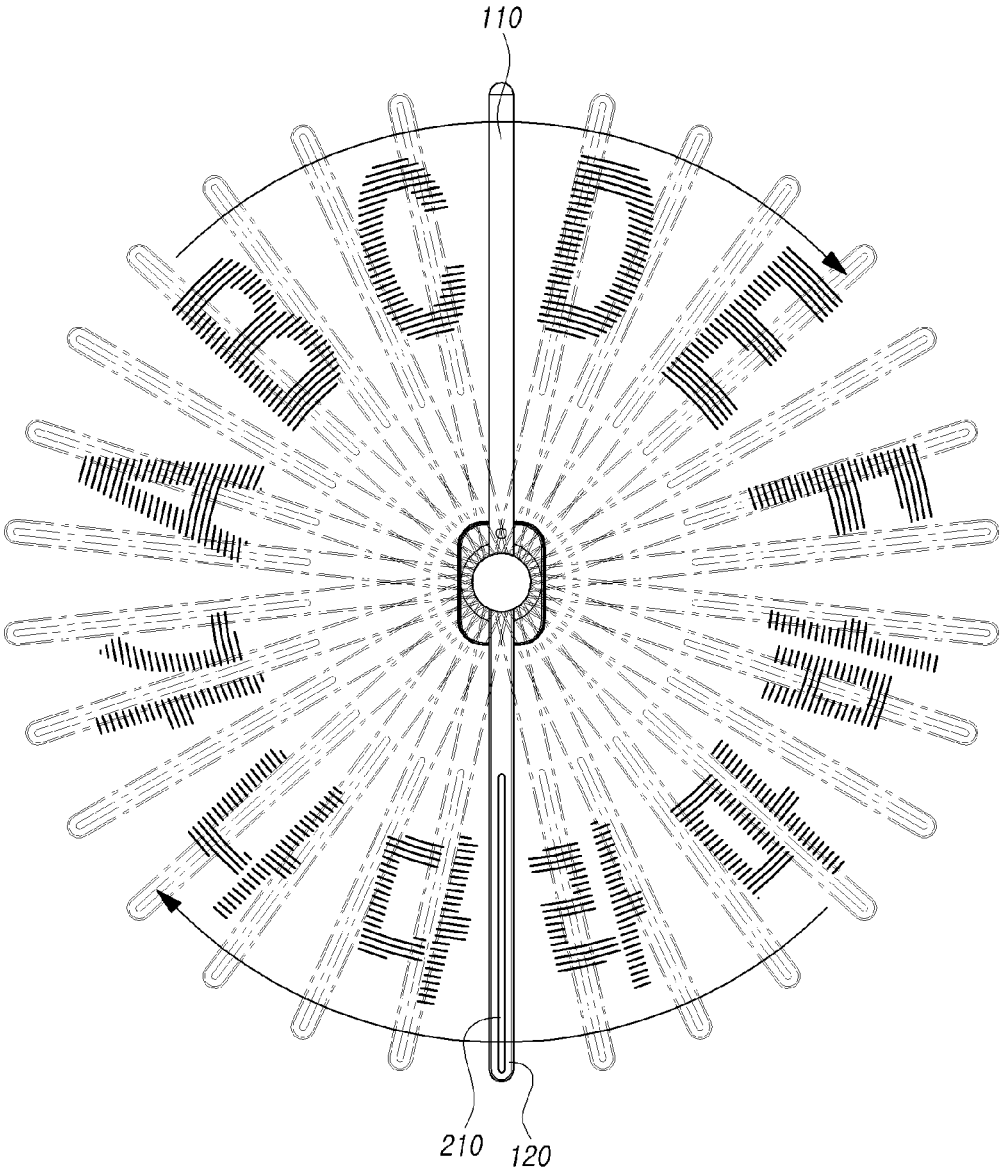
FIG. 3 is a front view illustrating an example of the operating state of a rotary LED display device according to the present embodiments.
Figure 4:
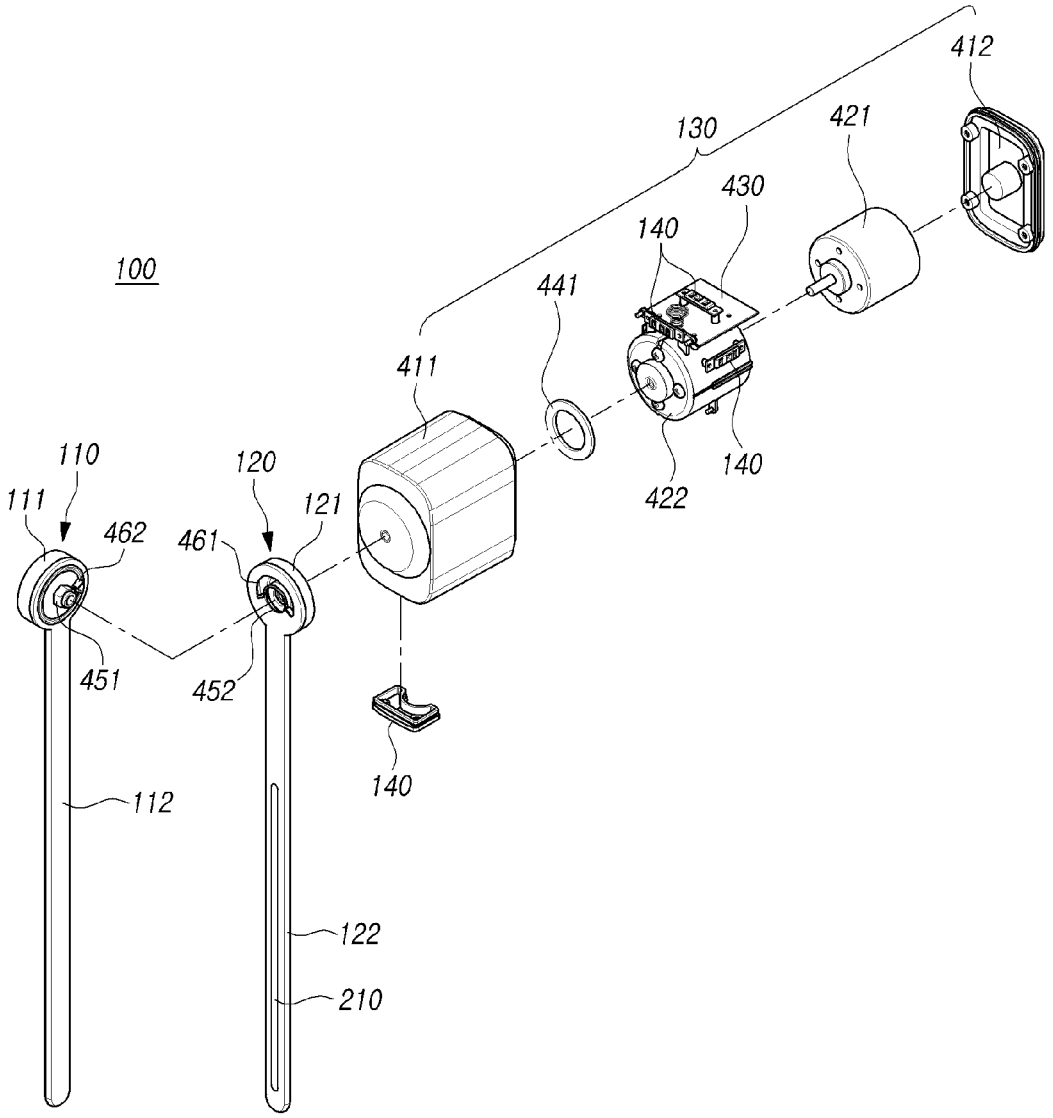
FIGS. 4 to 5 are exploded perspective views of a rotary LED display device according to the present embodiments.
Figure 5:
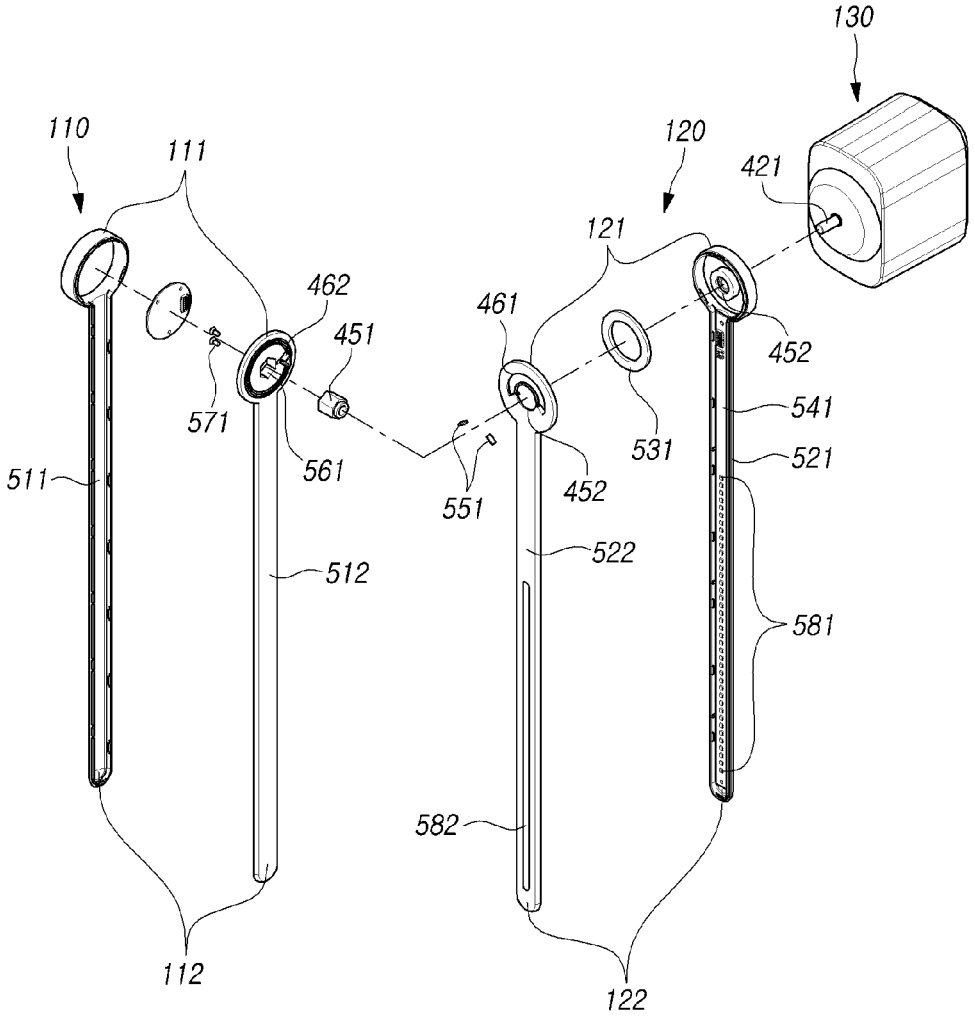
Figure 6:
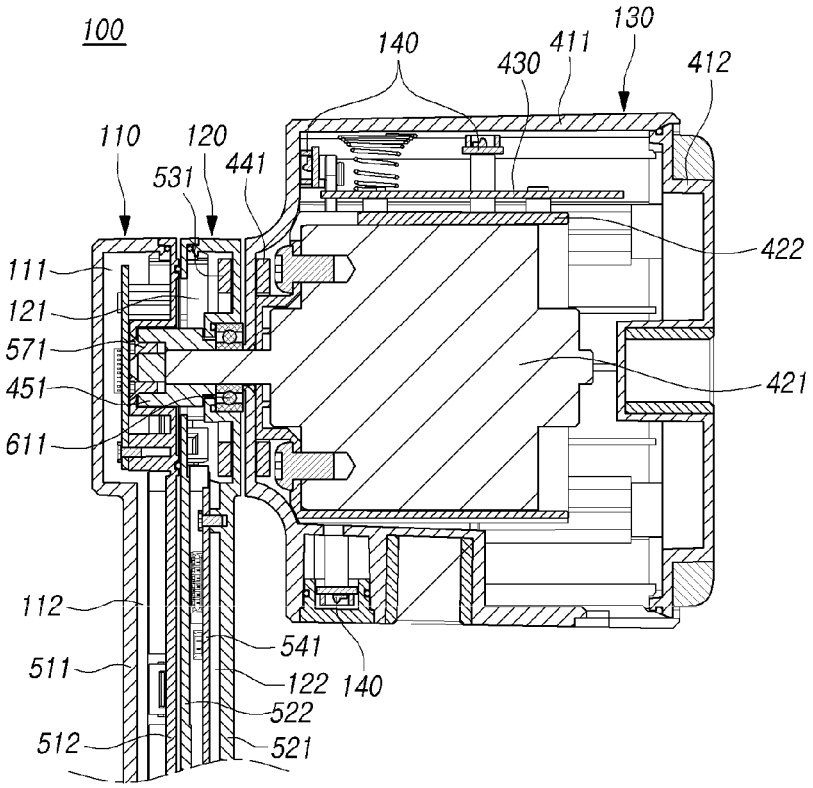
FIG. 6 is a cross-sectional view of a rotary LED display device according to the present embodiments.
Figure 7:
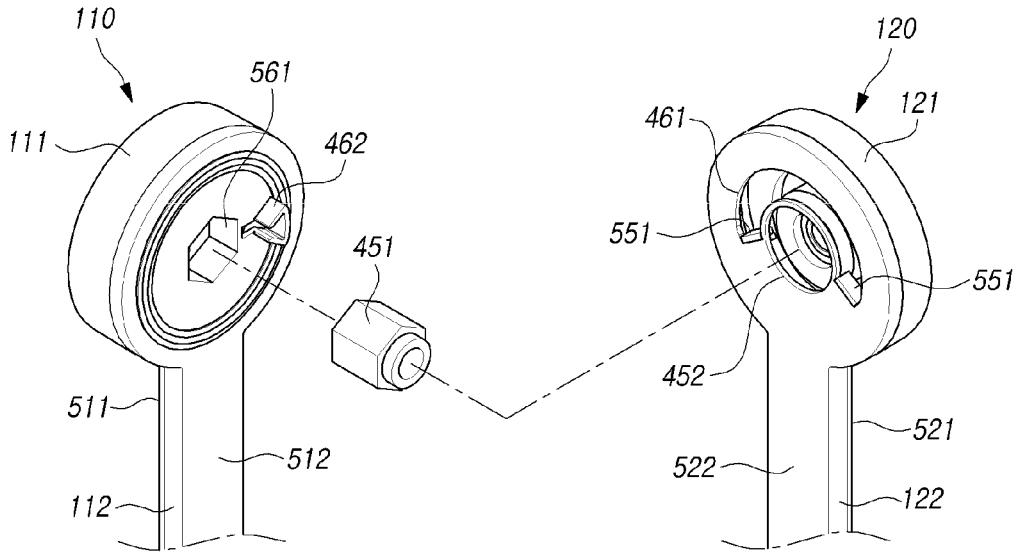
FIG. 7 is an exploded perspective view for a part of a rotary LED display device according to the present embodiments.
Figure 8:
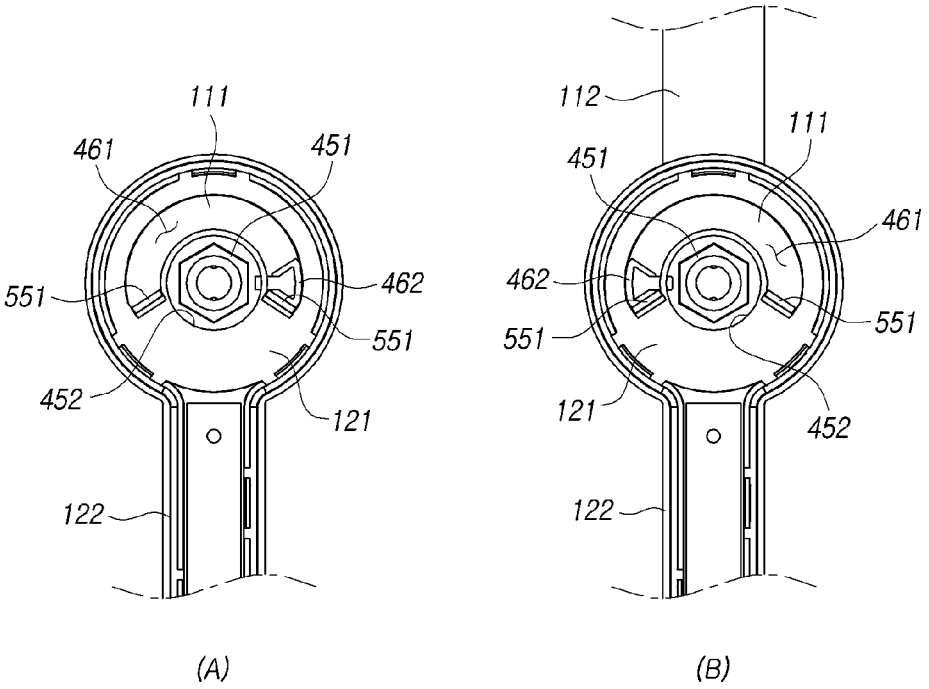
FIG. 8 illustrates the operation of a rotary LED display device according to the present embodiments.
Figure 9:
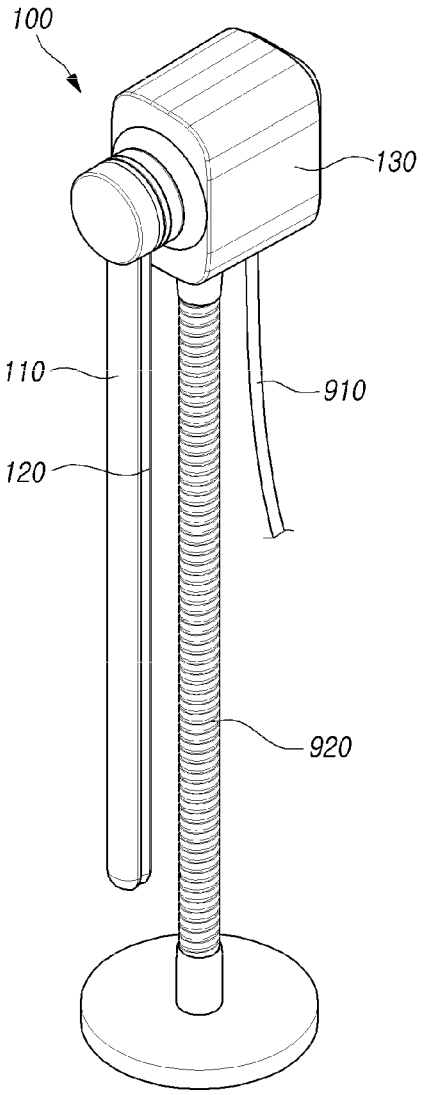
FIGS. 9 to 10 illustrate examples of the installation state of a rotary LED display device according to the present embodiments.
Figure 10:
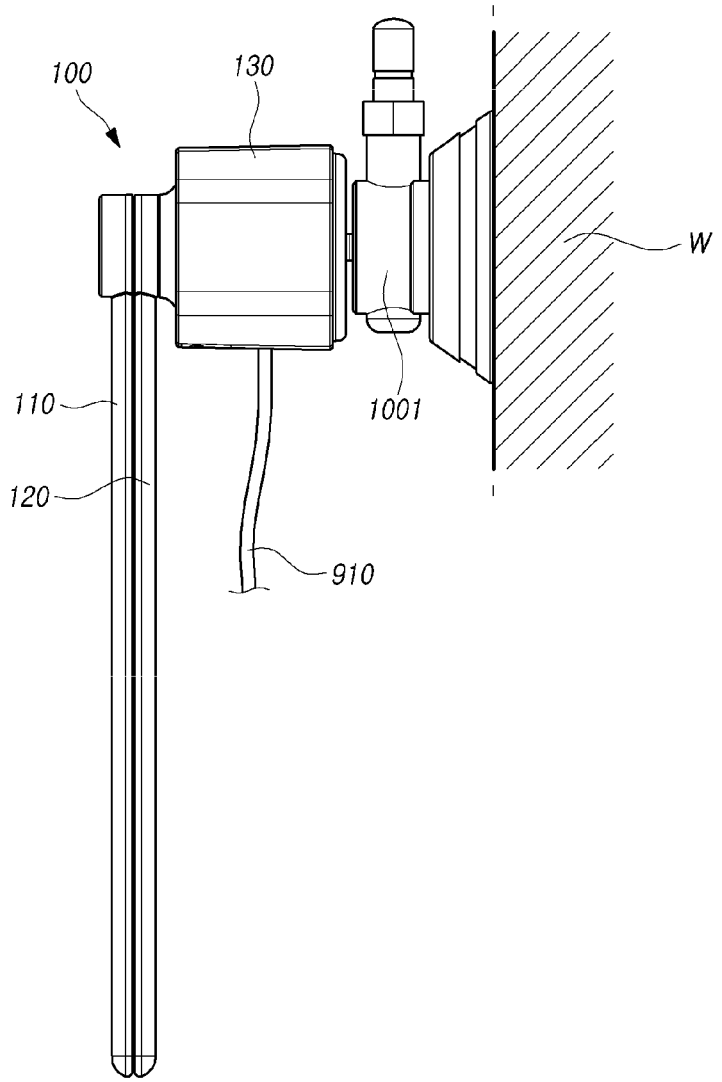

FIG. 1 is a perspective view of a rotary LED display device according to the present embodiments, FIG. 2 is a perspective view of a deployed state of a rotary LED display device according to the present embodiments, FIG. 3 is a front view illustrating an example of the operating state of a rotary LED display device according to the present embodiments, FIGS. 4 to 5 are exploded perspective views of a rotary LED display device according to the present embodiments, FIG. 6 is a cross-sectional view of a rotary LED display device according to the present embodiments, FIG. 7 is an exploded perspective view for a part of a rotary LED display device according to the present embodiments, FIG. 8 illustrates the operation of a rotary LED display device according to the present embodiments, and FIGS. 9 to 10 illustrate examples of the installation state of a rotary LED display device according to the present embodiments.

A rotary LED display device 100 according to the present embodiments includes a first rotation module 110 including a first center portion 111 and a first rod portion 112 extending in a radial direction from the first center portion 111, a second rotation module 120 including a second center portion 121 and a second rod portion 122 extending in a radial direction from the second center portion 121 and having an LED light emitting unit 210 provided on a front surface thereof, in which the first center portion 111 being coupled to a front surface of the second center portion 121 to be relatively rotatable within a predetermined range, and when a relative rotation angle is greater than or equal to the predetermined range, the second rotation module 120 rotating together with the first rotation module 110, and a driving module 130 including a motor 421 having a motor shaft coupled to the first center portion 111 to rotate the first rotating module 110 and a power control unit 430 for supplying and controlling power to the motor 421 and the LED light emitting unit 210.

Referring to FIGS. 1 to 3, a rotary LED display device 100 according to the present embodiments includes the first rotation module 110, the second rotation module 120, and the driving module 130.

The first rotation module 110 includes a first center portion 111 and a first rod portion 112, the first rod portion 112 is formed extending radially from the first center portion 111, and the first center portion 111 provides a center of rotation to the first rod portion 112. Similarly, the second rotation module 120 includes a second center portion 121 and a second rod portion 122, and the second rod portion 122 is formed to extend radially from the second center portion 121, and the second center portion 121 provides a center of rotation to the second rod portion 122. As shown in the drawing, the first center portion 111 and the second center portion 121 may be formed in a substantially circular shape, and the first rod portion 112 and the second rod portion 122 may be formed to have a constant width.

The first center portion 111 and the second center portion 121 are provided coaxially. That is, the first center portion 111 and the second center portion 121 are provided to overlap in the axial direction of the rotation center, and the rear surface of the first center portion 111 faces the front surface of the second center portion 121.

The LED light emitting unit 210 is provided in front of the second rod portion 122. In the case that the first rotation module 110 and the second rotation module 120 are rotated by the motor 421 of the driving module 130, the LED light emitting unit 210 provided on the front of the second rod portion 122 is exposed forward. In this case, the desired information may be displayed forward by the afterimage effect generated as the power control unit 430 of the driving module 130 supplies power to the LED light emitting unit 210.

The power control unit 430 supplies and controls power to the motor 421 and the LED light emitting unit 210. That is, the power control unit 430 controls the motor 421 to rotate the first rotation module 110 and the second rotation module 120 rotate at a constant speed, so that the light generated from the LED light emitting unit 210 can accurately display the desired information by the afterimage effect.

Although not shown in FIGS. 1 to 8, as shown in FIGS. 9 to 10, the driving module 130 may receive power from the outside through a cable 910, for example, may be connected to a power supply of a vehicle. The driving module 130 may be provided with a touch switch 150 for turning the driving module 130 on and off. The touch switch 150 may be, for example, provided on the upper surface of the driving module 130 as shown in FIGS. 1 to 2.

The user can freely and easily change the information to be displayed using an input device linked with the power control unit 430, for example, a dedicated application installed on a smartphone. The user can also freely select the color of each character, symbol, image, etc. of the information to be displayed.

The rotary LED display device 100 according to the present embodiments may be installed, for example, on the ground by a stand 920 as shown in FIG. 9. Alternatively, the rotary LED display device 100 may be installed in various places and locations in such a way that a suction unit 1001 is coupled to the rear side of the driving module 130 and the suction unit 1001 is attached to the wall W, etc. Therefore, the power control unit 430 may control the motor 421 so that the first rotation module 110 and the second rotation module 120 rotate at a constant speed even with different rotation resistance according to the installation environment. A magnet or an air absorption plate may be provided on the rear surface of the stand 920 or the driving module 130 to be stably fixed.

More specifically, referring to the operation of the rotary LED display device 100 according to the present embodiments, first, the first center portion 111 and the second center portion 121 are coupled to be relatively rotatable within a predetermined range. In this case, the power of the driving module 130 is directly transmitted only to the first rotation module 110 and is indirectly transmitted to the second rotation module 120 through the first rotation module 110.

That is, in the motor 421 of the driving module 130, the motor shaft is coupled to the first center portion 111 and provided to penetrate the second center portion 121 (refer to FIG. 6), the first rotation module 110 is preferentially rotated by the torque of the motor 421. Accordingly, if the first center portion 111 is rotated beyond a predetermined range in which the first center portion 111 can rotate relative to the second center portion 121, the first center portion 111 is supported by the second center portion 121 in the rotational direction and the second rotation module rotates together with the first rotation module 110. That is, the rotation of the second rotation module 120 is dependent on the rotation of the first rotation module 110. It will be described later a detailed coupling relationship between the first center portion 111 and the second center portion 121.

FIG. 1 illustrates a state in which the first rotation module 110 is not rotated, and FIG. 2 illustrates a deployed state in which the first rotation module 110 is relatively rotated with respect to the second rotation module 120.

As shown in the drawing, the predetermined range in which the first center portion 111 and the second center portion 121 can rotate relative to each other is preferably 180 degrees. That is, when the first rotation module 110 is rotated by the motor 421 and the second rotation module 120 is rotated depending on the first rotation module 110, the first rod portion 112 and the second rotation module 110 are rotated, the first rod portion 112 and the second rod portion 122 rotate in a straight line, thereby minimizing fluctuation or variations in the device. More preferably, the weights of the first rod portion 112 and the second rod portion 122 are matched, and the center of mass of the first rotation module 110 and the second rotation module 120 is matched with the rotation center when rotated in the deployed state, so that it is possible to minimize the fluctuation of the device. In other words, the first rod portion 112 serves as a weight for reducing the fluctuation generated when the second rod portion 122 including the LED light emitting unit 210 is rotated.

The first rod portion 112 and the second rod portion 122 may be formed to have the same radial length as shown in the drawings. Therefore, in the non-operational state as shown in FIG. 1, the front of the second rod portion 122 having the LED light emitting unit 210 is covered by the first rod portion 112, and the LED light emitting unit 210 may be exposed to the front only when the driving module 130 rotates.

As the first rotation module 110 and the second rotation module 120 rotate, the LED light emitting unit 210 is exposed to the front, and the light of the LED light emitting unit 210 may display necessary information by using the afterimage effect. That is, the power control unit 430 may display a fixed or moving text or image by controlling the LED light emitting unit 210 in accordance with the rotation period of the second rotation module 120. As shown in FIG. 3, these texts or images may be displayed to be arranged along the rotational direction.

According to an embodiment, information displayed on the LED light emitting unit 210 may be divided into a plurality of parts, and information displayed on the divided plurality of parts may be independently controlled. That is, the information displayed on the plurality of divided parts may be the same or different. For example, the information displayed on the LED light emitting unit 210 may be divided into an upper and lower part. For example, different texts or images may be displayed on the upper side and the lower side, or the image may be displayed on the upper side and the text may be displayed on the lower side.

The LED light emitting unit 210 includes a plurality of LED light sources 581 arranged along the radial direction (refer to FIG. 5). Accordingly, the area of displaying the necessary information is the area between the circle drawn by the innermost light source and the circle drawn by the outermost light source, and the user can freely select and display desired information within the area.

In addition, one or more sensors 140 for detecting an object adjacent to the driving module 130 may be provided in the driving module 130. That is, for a natural display, the first rotation module 110 and the second rotation module 120 are required to be rotated at high speed. In this case, for example, if a person is adjacent to and collides with the first rotation module 110 or the second rotation module 120, there is a risk of causing a serious injury or damaging the device. Accordingly, the power control unit 430 may brake the motor 421 when an object approaching within a predetermined distance from the driving module 130 is detected from the signal detected by the sensor 140.

The sensor 140 may be provided on at least one of the front surface, rear surface, upper surface, lower surface, left surface and right surface of the driving module 130. Preferably, the sensors may be provided on all of the front, rear, upper, lower, left and right surfaces, and the sensors 140 provided on the front surface, upper surface and right surface are illustrated in FIG. 1.

Hereinafter, it will be described detailed components of the rotary LED display device 100 according to the present embodiments in detail with reference to FIGS. 4 to 8. Meanwhile, although an embodiment in which each component is coupled by bolting is illustrated in the drawings, the present embodiments are not limited thereto. In addition, a sealing member for preventing the inflow of external substances such as moisture may be provided on the coupling surface of each component.

First, referring to FIG. 4, the driving module 130 may include a housing 411 having a space for accommodating the motor 421, the power control unit 430, and a housing cover 412 covering the opening of the housing 411. The housing 411 is formed in a substantially hexahedral shape so that the motor shaft of the motor 421 protrudes from the front side, and the motor 421 is inserted into the rear side and the housing cover 412 is coupled thereto.

The motor 421 is coupled to the housing 411 by a motor housing 422. That is, the motor 421 is coupled to the motor housing 422, and the motor housing 422 to which the motor 421 is coupled is coupled to the inside of the housing 411, so that the motor 421 may be fixed inside the housing 411.

The power control unit 430 is coupled to the upper side of the motor housing 422 as shown, so that, when the motor housing 422 is coupled to the housing 411, the power control unit may be fixed inside the housing 411 together.

The sensor 140 is also coupled to the motor housing 422 and may be provided inside the housing 411, but the sensor 140 provided on the lower surface may be coupled to the lower surface of the housing 411.

A first winding 441 is provided to interact with a second winding 531 provided in the second rotation module 120, and the power control unit 430 supplies power to the LED light emitting unit 210 through the first winding 441 and the second winding 531. The first winding 441 and the second winding 531 are provided to face each other with a second case 521 and the housing 411 interposed therebetween (refer to FIG. 6). That is, although not shown in the drawing, the power control unit 430 may be directly connected to the motor 421 and the sensor 140 through a cable to supply power, and may be wirelessly connected to the LED light emitting unit 210 through the first winding 441 and the second winding 531 to supply power.

The second rotation module 120 rotates together depending on the rotation of the first rotation module 110 during operation. Accordingly, by adopting a wireless connection method through the first winding 441 and the second winding 531 rather than a wired connection, it is possible to stably maintain the electrical connection during rotational operation.

Referring to FIG. 5, the first rotation module 110 includes a first case 511 and a first case cover 512, and the second rotation module 120 includes a second case 521 and a second case cover 522.

The first case 511 and the second case 521 form an empty space therein, respectively, and the first case cover 512 and the second case cover 522 are coupled to the first case 511 and the second case 521 to cover each empty space.

In the first rotation module 110, the first case 511 is located in the front, the empty space inside is opened to the rear, and the first case cover 512 may be coupled to the rear surface of the first case 511. In the second rotation module 120, the second case 521 is located at the rear so that the empty space inside is opened to the front, and the second case cover 522 may be coupled to the front surface of the second case 521. The second winding 531 is provided at portions of the second case 521 and the second case cover 522 that form the second center portion 121. A substrate 541 for constituting the LED light emitting unit 210 is provided in the second case 521 forming the second rod portion 122. In addition, the second case cover 522 is provided with an LED window 582 formed in a transparent or semi-transparent so that the light generated from the LED light source 581 is transmitted.

In addition, in the first rotation module 110 and the second rotation module 120, there may be formed a guide protrusion 462 and a guide slit 461 enabling for the first rotation module 110 and the second rotation module 120 to rotate relative to each other within a predetermined range and to rotate together beyond the predetermined range. These will be described later in detail with reference to FIGS. 7 to 8.

The first rotation module 110 is fixedly coupled in the rotational direction with respect to the motor shaft of the motor 421. Specifically, a fixing member 451 with a polygonal column shape is coupled to the motor shaft of the motor 421. In the canter portion 1111, there may be formed a coupling groove 561 formed in a shape corresponding to the fixing member 451 and into which the fixing member 451 is inserted, so that the first rotation module 110 may be fixed to the motor shaft of the motor 421.

The coupling groove 561 is formed on the rear surface of the first case cover 512, and the fixing member 451 is inserted into the coupling groove 561. The first center portion 111 is coupled to the fixing member 451 by a bolt 571 that passes through the first case cover 512 from the front of the first case cover 512 and is coupled to the fixing member 451.

The fixing member 451 may be formed in a hexagonal column shape as shown, and the coupling groove 561 may also be formed in a hexagonal groove shape.

Referring to FIGS. 5 to 6, the motor shaft of the motor 421 to which the fixing member 451 is coupled may be provided to pass through the second center portion 121. That is, a through hole 452 through which the motor shaft of the motor 421 passes is formed in the second center portion 121, and the second center portion 121 is coupled to the motor shaft of the motor 421 by a bearing 611.

That is, the fixing member 451 and the bearing 611 are coupled to the motor shaft of the motor 421, the first rotation module 110 is coupled to the fixing member 451, and the second rotation module 110 is coupled to the bearing 611. Accordingly, the torque of the motor 421 is directly transmitted to the first rotation module 110, but not directly to the second rotation module 120, but is transmitted indirectly through the first rotation module 110.

Referring to FIGS. 7 to 8, a guide slit 461 formed in the rotational direction is formed on either one of the rear surface of the first center portion 111 and the front surface of the second center portion 121, and a guide protrusion 462 inserted into the guide slit 461 is formed on the other one. By using the guide slit 461 and the guide protrusion 462, the first rotation module 110 and the second rotation module 120 can be relatively rotated within a predetermined range, but are rotated together beyond the predetermined range. More specifically, the guide slit 461 and the guide protrusion 462 may be formed on the rear surface of the portion forming the first center portion 111 of the first case cover 512 and on the front surface of the portion forming the second center portion 121 of the second case cover 522. The figure illustrates an embodiment in which the guide protrusion 462 is formed on the first case cover 512 and the guide slit 461 is formed on the second case cover 522.

That is, the first rotation module 110 is coupled to the motor shaft of the motor 421 by the fixing member 451 and the second rotation module 120 is coupled to the motor shaft of the motor 421 by the bearing 611. In addition, the first rotation module 110 and the second rotation module 120 are coupled by the guide slit 461 and the guide protrusion 462.

The guide slit 461 is formed in the rotational direction, and is formed in an arc shape on the main surface of the through hole 452 as shown in the figure, thereby providing the guide protrusion 462 with a movement path in the rotational direction. Accordingly, the range in which the guide protrusion 462 can move on the guide slit 461 becomes the predetermined range in which the first rotation module 110 and the second rotation module 120 can relatively rotate. For example, if the relative rotation range is set to 180 degrees as described above, the guide protrusion 462 may move on the guide slit 461 by a range of 180 degrees.

The guide protrusion 462 protrudes from the first case cover 512 toward the second case cover 522 so that the guide protrusion is inserted into the guide slit 461 when the first rotation module 110 and the second rotation module 120 are connected to the motor 421. The guide protrusion may be formed in a substantially sectoral shape as shown.

As the first rotation module 110 and the second rotation module 120 rotate relative to each other, the guide protrusion 462 moves along the guide slit 461. As shown in FIGS. 1 and 7 (A), in the state in which the first rod portion 112 and the second rod portion 122 are overlapped, the guide protrusion 462 is supported on one end of the guide slit 461. As shown in FIGS. 2 and 7 (B), in a state in which the first rod portion 112 and the second rod portion 122 are deployed, the guide protrusion 462 may be supported on the other end of the guide slit 461.

In addition, dampers 551 are provided at both ends of the guide slit 461 in the rotational direction to dampen the impact when the guide protrusion 462 is supported on one end or the other end of the guide slit 461 to increase durability and reduce the noise.

Figure 11:
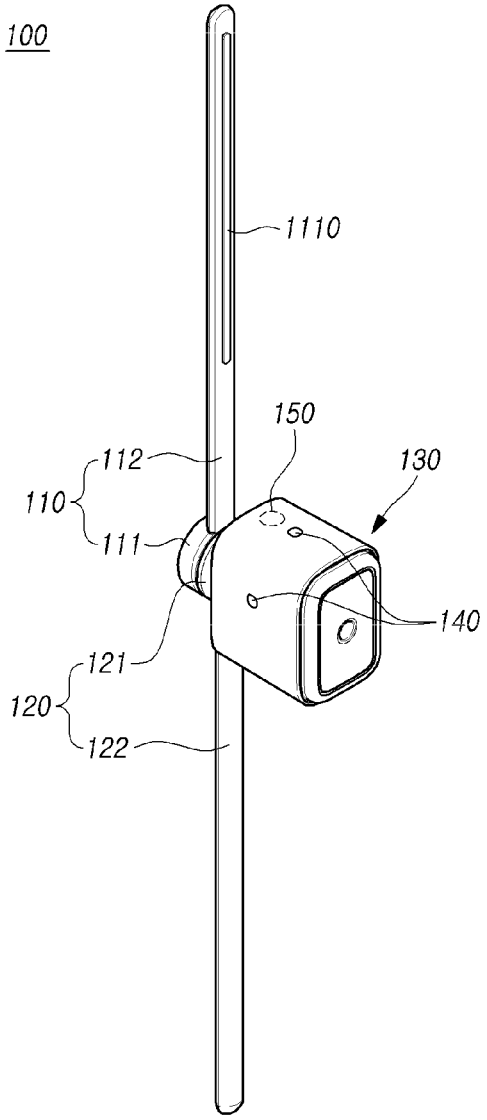
FIG. 11 is a perspective view of a deployed state of a rotary LED display device according to the present embodiments.
Figure 12:
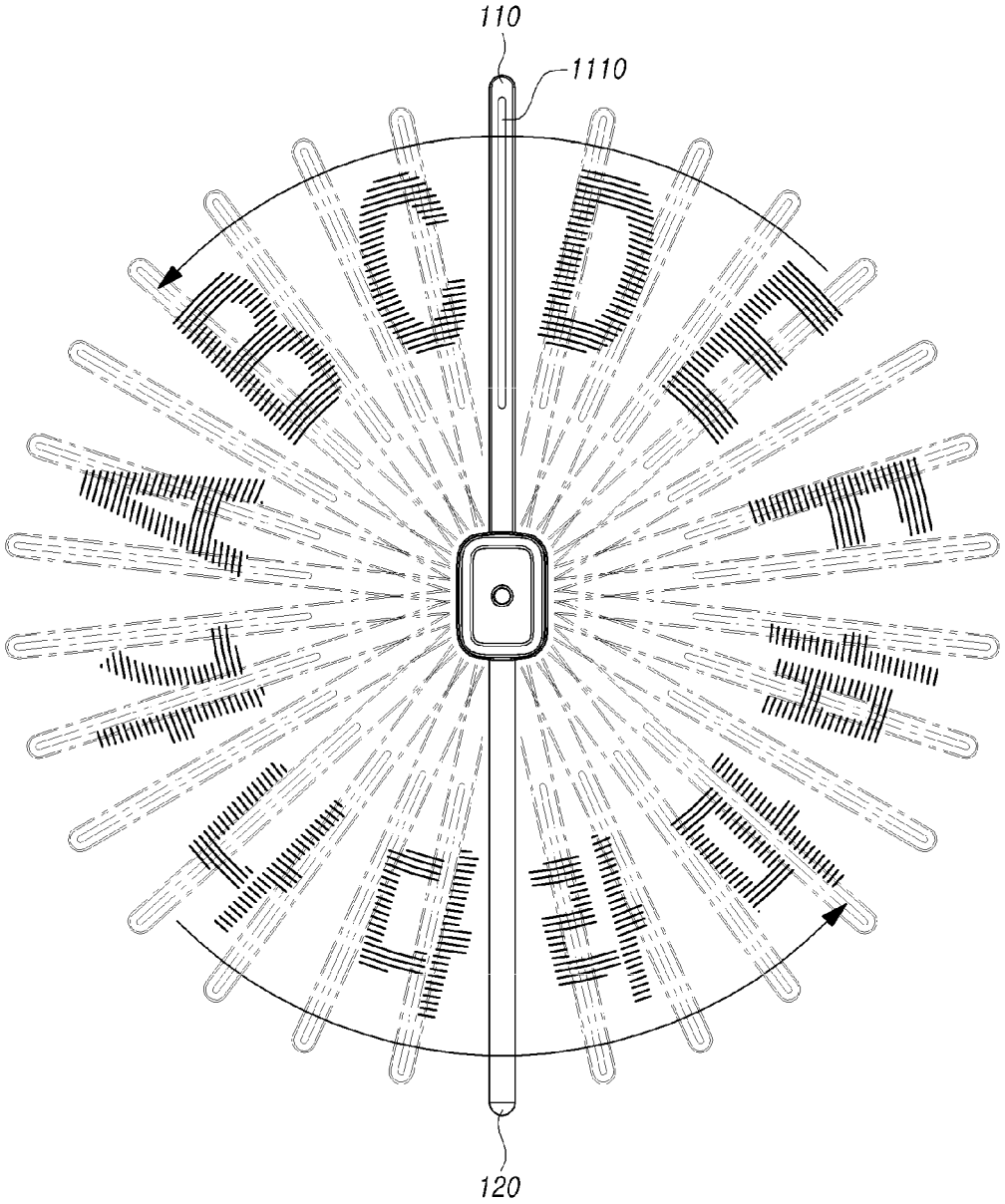
FIG. 12 is a front view illustrating an example of the operating state of a rotary LED display device according to the present embodiments.

Referring to FIGS. 11 and 12, an LED light emitting unit 1110 may be also provided on the rear surface of the first rod portion 112, so that the rotary LED display device 100 according to the present embodiments may display desired information not only on the front surface of the device but also on the rear surface. That is, the light generated from the LED light emitting unit 210 provided on the front surface of the second rod portion 122 displays information toward the front side of the device 100 by the afterimage effect, and the light generated from the LED light emitting unit 1110 provided on the rear surface of the first rod portion 112 may display information toward the rear side of the device 100 by the afterimage effect.

Similarly, the LED light emitting unit 1110 of the first load unit 112 may be similarly controlled by the power control unit 430, and the user can easily change the information to be displayed through an input device linked with the power control unit 430. Information displayed on each of the LED light emitting units 210 and 1110 may be the same or different. In the case that the same information is displayed on both LED light emitting units 210 and 1110, the power control unit 430 may control the information displayed on both LED light emitting units 210 and 1110 to be symmetrical so as to display the same information on the front and rear side.

Meanwhile, the rotary LED display device 100 according to the present embodiments may further include an IoT communication module for receiving advertisement content from the terminal, and a storage module for storing the received advertisement content. The power control unit 430 may control the LED light emitting units 210 and 1110 to display the received advertisement content.

The terminal may be, for example, a smartphone, and the smartphone user may download an application for LTE connection with the IoT communication module and transmit advertisement content to be displayed through the application. That is, the IoT communication module is provided by mounting a communication chip certified by a communication company in the device 100 according to the present embodiments, and advertisement content can be received from the terminal. The IoT communication module can receive advertisement content in the LTE IoT method, for example, receive advertisement content in an eMTC or NB IoT method.

The advertisement contents transmitted from the terminal are stored in the storage module, and the power control unit 430 may display the advertisement contents stored in the storage module through the LED light emitting units 210 and 1110. For example, the power control unit 430 may display the received advertisement content after the information that was being displayed ends, or may end the information that was being displayed at the time the advertisement content was received and immediately display the received advertisement content. In addition, the power control unit 430 may display the received advertisement content for a predetermined time or until new advertisement content is received.

Meanwhile, the rotary LED display deice 100 according to the present embodiments may further include a sensor module for collecting environmental data, and a transmission module for transmitting the collected environmental data to the outside.

The sensor module collects environmental data around the location where the device 100 according to the present embodiments is installed. The collected environmental data may include data on the concentration of fine dust, or may include data such as precipitation, amount of sunshine, temperature, and humidity.

As the device 100 according to the present embodiments is installed in various regions for information display, it may be possible to make big data of the environmental data collected by the sensor module. That is, the transmission module transmits the environmental data collected by the sensor module to the outside. The transmission module may transmit the collected environmental data to a management server, and the management server may generate a big data for the environmental data. The big data for the environmental data may be provided and used by, for example, government departments and related institutions.

According to the rotary LED display device having such a shape, the size of the device can be miniaturized and can be installed in various positions, so that the restrictions of the installation space and place are released. In addition, the user can immediately and easily change the display contents, and it is possible to satisfy durability suitable for long-term operation.

The above description has been presented to enable any person skilled in the art to make and use the technical idea of the present disclosure, and has been provided in the context of a particular application and its requirements. Various modifications, additions and substitutions to the described embodiments will be readily apparent to those skilled in the art, and the general principles defined herein may be applied to other embodiments and applications without departing from the spirit and scope of the present disclosure. The above description and the accompanying drawings provide an example of the technical idea of the present disclosure for illustrative purposes only. Thus, the scope of the present disclosure is not limited to the embodiments shown. The scope of protection of the present disclosure should be construed based on the following claims, and all technical ideas within the scope of equivalents thereof should be construed as being included within the scope of the present disclosure.

What is claimed is:

1. A rotary LED display device comprising:

a first rotation module including a first center portion and a first rod portion extending in a radial direction from the first center portion;

a second rotation module including a second center portion and a second rod portion extending in a radial direction from the second center portion and having an LED light emitting unit provided on a front surface thereof, in which the first center portion being coupled to a front surface of the second center portion to be relatively rotatable within a predetermined range, and when a relative rotation angle is greater than or equal to the predetermined range, the second rotation module rotating together with the first rotation module; and a driving module including a motor having a motor shaft coupled to the first center portion to rotate the first rotating module and a power control unit for supplying and controlling power to the motor and the LED light emitting unit.

2. The rotary LED display device of claim 1, wherein the LED light emitting unit includes a plurality of LED light sources arranged along a radial direction.

3. The rotary LED display device of claim 1, wherein the driving module is provided with one or more sensors for detecting an object adjacent to the driving module.

4. The rotary LED display device of claim 3, wherein the sensor is provided on at least one of a front surface, a rear surface, an upper surface, a lower surface, a left surface, or a right surface of the driving module.

5. The rotary LED display device of claim 3, wherein the power control unit brakes the motor when an object approaches within a predetermined distance from the driving module is detected by using a detection signal of the sensor.

6. The rotary LED display device of claim 1, wherein the predetermined range is 180 degrees.

7. The rotary LED display device of claim 1, wherein a fixing member of a polygonal column shape is coupled to the motor shaft of the motor, and a coupling groove is formed in the first center portion to have a shape corresponding to the fixing member and into which the fixing member is inserted.

8. The rotary LED display device of claim 7, wherein the first center portion is coupled to the fixing member by bolting.

9. The rotary LED display device of claim 7, wherein the fixing member is formed in a hexagonal column shape.

10. The rotary LED display device of claim 1, wherein a through hole through which the motor shaft of the motor passes is formed in the second center portion, and the second center portion is coupled to the motor shaft of the motor by a bearing.

11. The rotary LED display device of claim 1, wherein a guide slit formed in a rotational direction is formed on one of a rear surface of the first center portion and a front surface of the second center portion, and a guide protrusion inserted into the guide slit is formed on the other of the rear surface of the first center portion and the front surface of the second center portion.

12. The rotary LED display device of claim 11, wherein dampers are provided at both ends of the guide slit in the rotational direction.

13. The rotary LED display device of claim 1, wherein the driving module includes a first winding connected to the power control unit and the second rotation module includes a second winding connected to the LED light emitting unit, and power is supplied from the power control unit to the LED light emitting unit by the first winding and the second winding.

14. The rotary LED display device of claim 1, wherein, as the second rotation module is rotated by the motor, the power control unit controls the LED light emitting unit to display information toward the front.

15. The rotary LED display device of claim 14, wherein the information displayed on the LED light emitting unit is divided into a plurality of parts, and the information displayed on the plurality of parts is independently controlled.

16. The rotary LED display device of claim 15, wherein the information displayed by the LED light emitting unit is divided into upper and lower parts.

17. The rotary LED display device of claim 1, wherein the LED light emitting unit is further provided on a rear surface of the first rod portion.

18. The rotary LED display device of claim 1, further comprising:

an IoT communication module for receiving advertisement content from a terminal; and a storage module for storing the received advertisement content, wherein the power control unit controls the LED light emitting unit to display the received advertisement content.

19. The rotary LED display device of claim 1, further comprising:

a sensor module for collecting environmental data; and a transmission module for transmitting the collected environmental data to the outside.

20. The rotary LED display device of claim 19, wherein the environmental data includes data on a concentration of fine dust.

* * * * *